US008454317B2

(12) United States Patent
Bohl et al.

(10) Patent No.: US 8,454,317 B2
(45) Date of Patent: Jun. 4, 2013

(54) RADIAL OR DIAGONAL FAN WHEEL

(75) Inventors: Katrin Bohl, Künzelsau (DE); Marc Schneider, Dörzbach (DE); Jürgen Schöne, Bad Mergentheim (DE)

(73) Assignee: EBM-Papst Mulfingen GmbH & Co. KG, Mulfingen (DE)

( * ) Notice: Subject to any disclaimer, the term of this patent is extended or adjusted under 35 U.S.C. 154(b) by 528 days.

(21) Appl. No.: 12/705,103

(22) Filed: Feb. 12, 2010

(65) Prior Publication Data

US 2010/0202887 A1 Aug. 12, 2010

(30) Foreign Application Priority Data

Feb. 12, 2009 (EP) ..... 09152661

(51) Int. Cl.
*F01D 5/22* (2006.01)

(52) U.S. Cl.
USPC ..... 416/186 R; 416/179; 416/183

(58) Field of Classification Search
USPC ..... 416/186 R, 183, 179, 203
See application file for complete search history.

(56) References Cited

U.S. PATENT DOCUMENTS

| | | | | |
|---|---|---|---|---|
| 2,724,544 | A | 5/1951 | Hardigg | |
| 6,210,116 | B1 * | 4/2001 | Kuczaj et al. | 416/185 |
| 6,386,683 | B1 | 5/2002 | Muroi et al. | |
| 6,386,831 | B1 * | 5/2002 | Stahl et al. | 416/186 R |
| 8,133,009 | B2 * | 3/2012 | Salvesen | 415/118 |
| 2007/0116561 | A1 | 5/2007 | Hill et al. | |

FOREIGN PATENT DOCUMENTS

| | | | |
|---|---|---|---|
| DE | 2 165 610 | | 7/1973 |
| DE | 29 40 773 | A1 | 8/1979 |
| DE | 199 18 085 | A | 10/2000 |
| DE | 203 03 443 | U1 | 7/2003 |
| DE | 603 11 165 | T2 | 1/2008 |
| EP | 1 032 766 | B1 | 3/2002 |
| EP | 1 574 716 | A1 | 9/2005 |
| EP | 1 348 871 | B1 | 1/2007 |
| EP | 1 933 039 | A1 | 6/2008 |
| GB | 438 036 | | 11/1935 |
| GB | 2063365 | B | 9/1980 |
| JP | 60-113095 | | 6/1985 |
| JP | 2001-173595 | | 6/2001 |
| JP | 2001-263294 | A | 9/2001 |

OTHER PUBLICATIONS

Catalog—Kunststofftechnik KG—Trilingual—KT Heavy Duty Thermoplastik Radial Fans—Jan. 2011.
Price List Kunststofftechnik KG—Apr. 1977.
European Search Report—European Patent No. 09152661.6; mailed on Aug. 5, 2009.

* cited by examiner

*Primary Examiner* — Edward Look
*Assistant Examiner* — Justin Seabe
(74) *Attorney, Agent, or Firm* — Brinks Hofer Gilson & Lione

(57) ABSTRACT

The present invention relates to a fan wheel in a version as a radial or diagonal fan, of a baseplate and of a plurality of fan blades arranged so as to be distributed over the circumference of the inlet port and around an axis of rotation. The fan wheel has a shroud with an inlet port and the shroud and/or the baseplate have/has in this case a nonrotationally symmetrical geometry which in each case has a continuous and point-invariable profile, as seen in the axial or axially parallel direction.

14 Claims, 5 Drawing Sheets

Fig.1
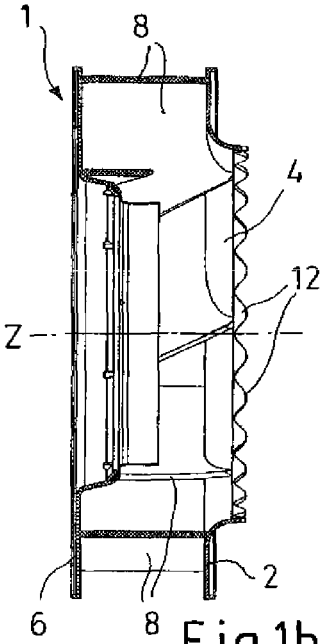
Fig.1b
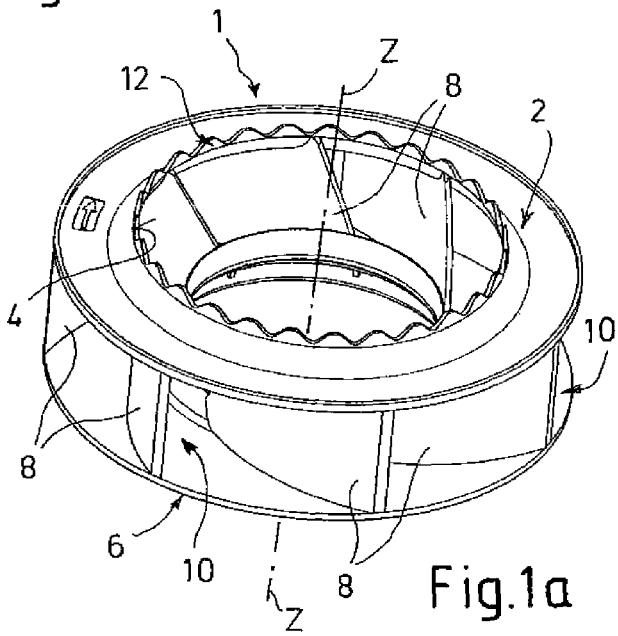
Fig.1a
Fig.2
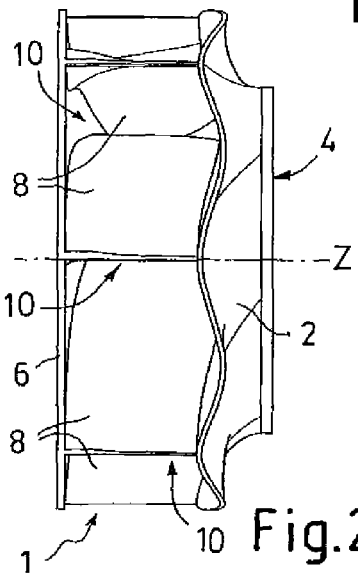
Fig.2b
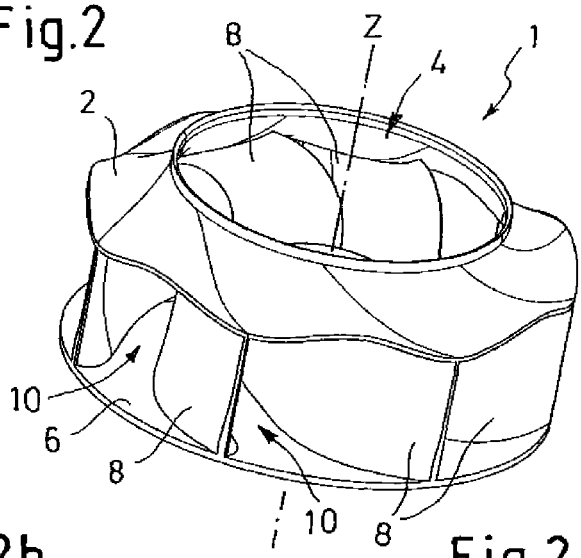
Fig.2a

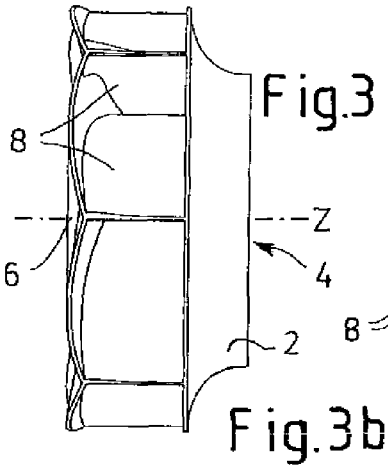
Fig.3
Fig.3b
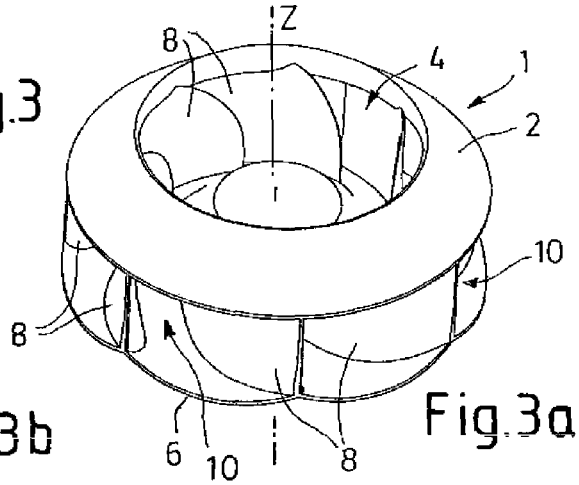
Fig.3a
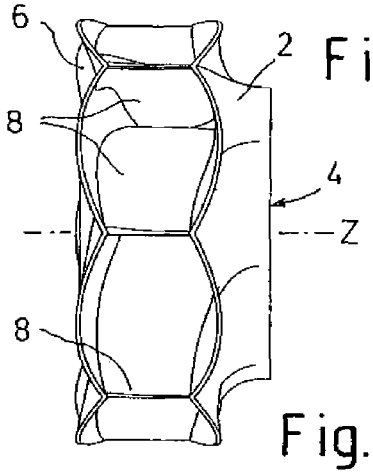
Fig.4
Fig.4b
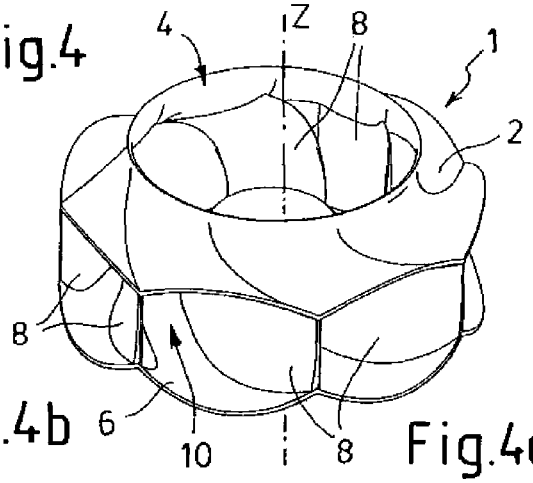
Fig.4a
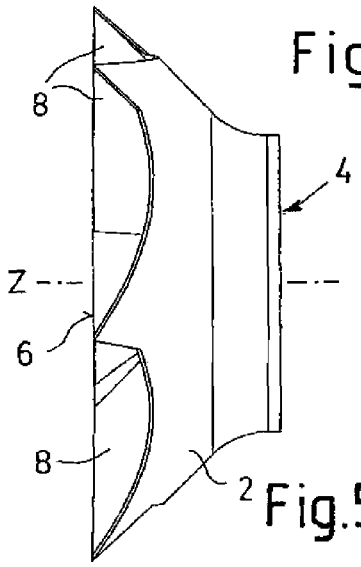
Fig.5
Fig.5b
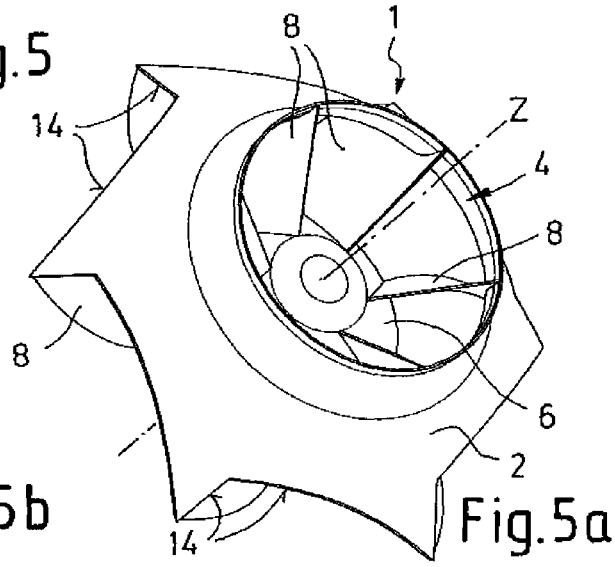
Fig.5a

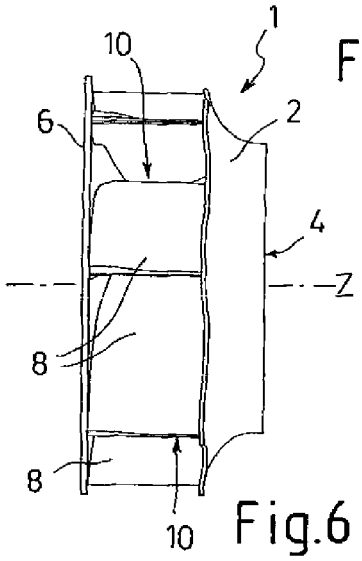
Fig.6b
Fig.6
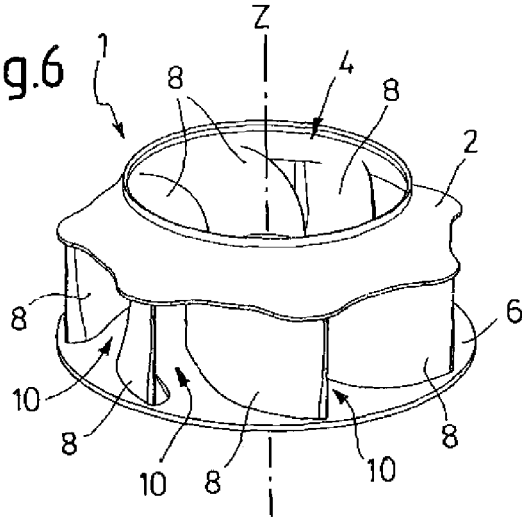
Fig.6a
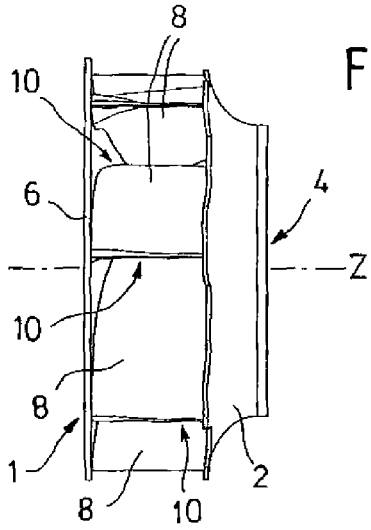
Fig.7b
Fig.7
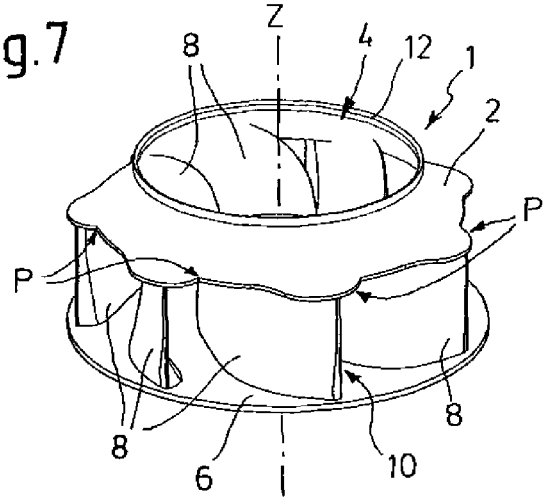
Fig.7a

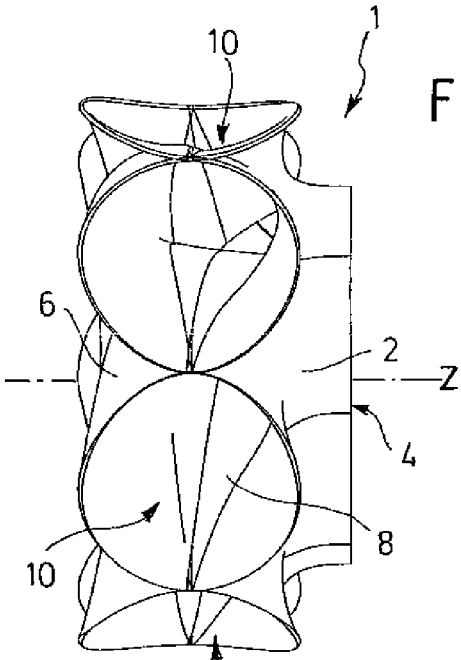
Fig.8b
Fig.8
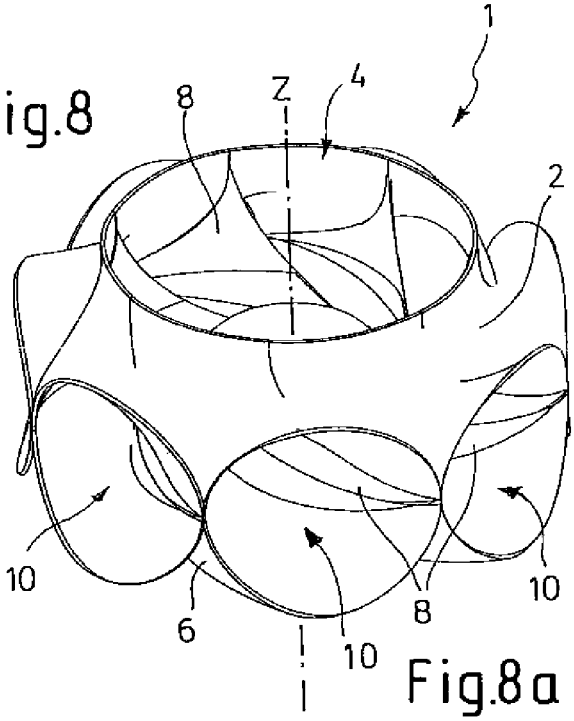
Fig.8a
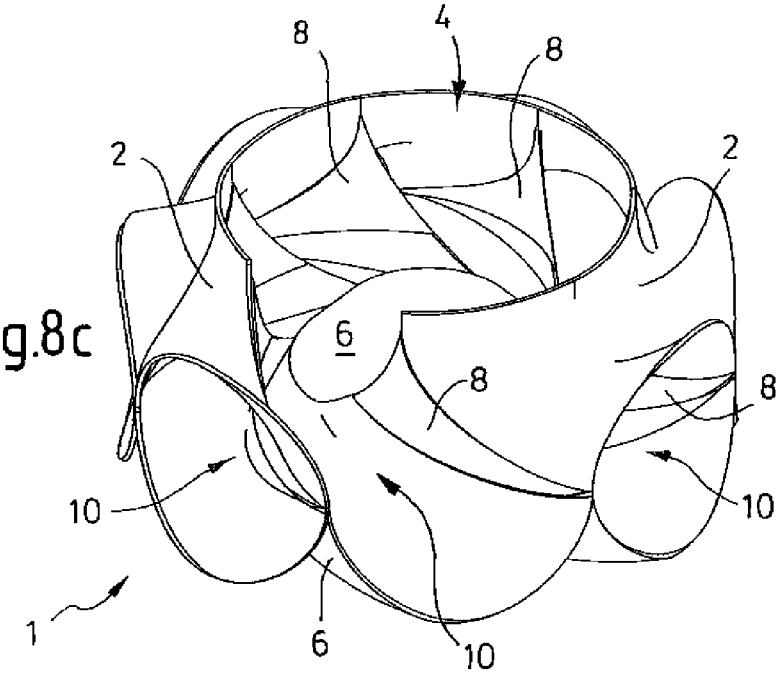
Fig.8c

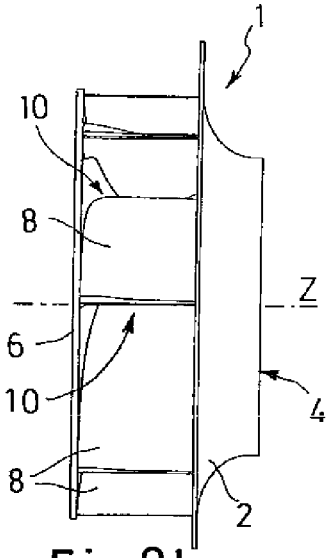
Fig.9b
Fig.9
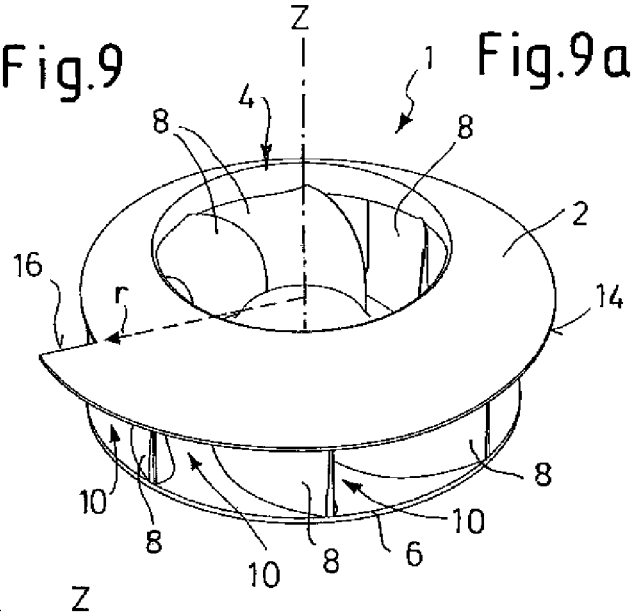
Fig.9a
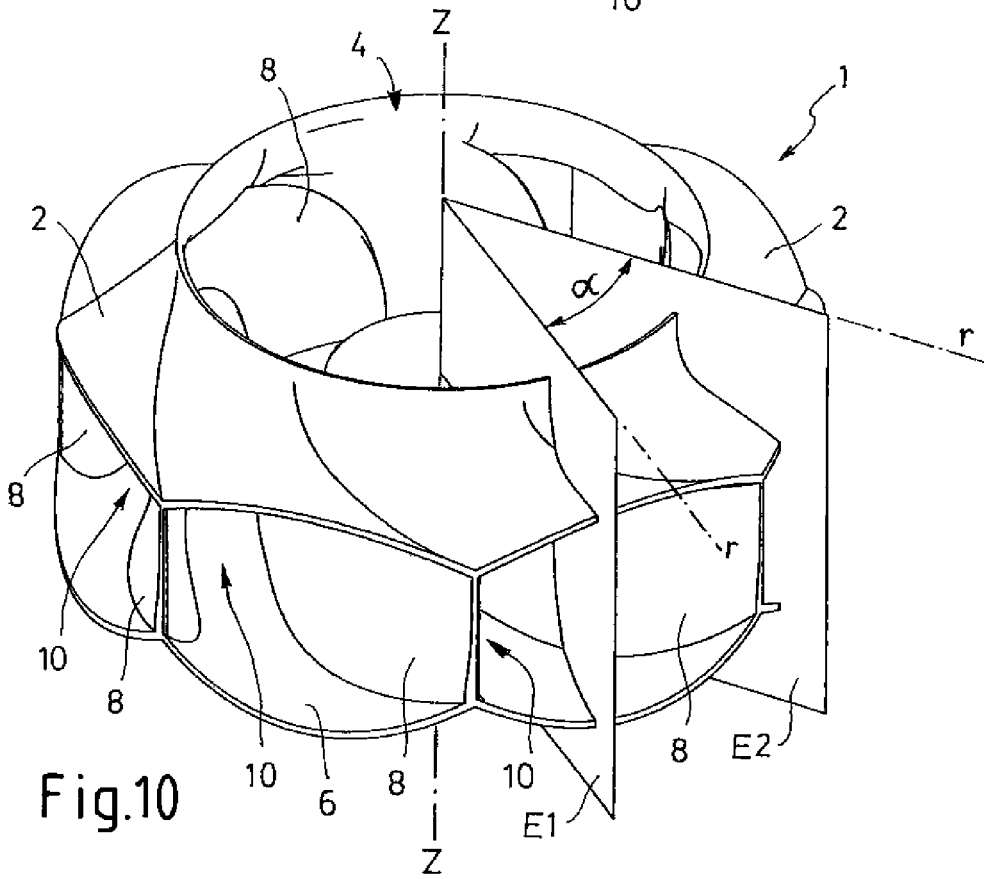
Fig.10

RADIAL OR DIAGONAL FAN WHEEL

CROSS REFERENCE TO RELATED APPLICATIONS

This application claims the benefit of priority to EP 09152661.6 filed Feb. 12, 2009, the entire contents of which are each hereby incorporated herein by reference.

FIELD OF INVENTION

The present invention relates to a fan wheel in a version as a radial or diagonal fan, consisting of a shroud with an inlet port, of a baseplate and of a plurality of fan blades arranged so as to be distributed over the circumference of the inlet port and around an axis of rotation, the shroud and/or the baseplate having a nonrotationally symmetrical geometry.

In this context, the term "nonrotationally symmetrical" means that any two different radial sections through the baseplate and/or the shroud in two planes, which contain the axis of rotation and form a specific differential angle in the circumferential direction, are not congruent at different circumferential angles but deviate from one another. A deviation could in this case be present basically in the direction of the axis of rotation (axially) and/or in the radial direction (radially). In other words, this means that, in the case of a nonrotational symmetry, a rotation of the body through specific angles about the axis of rotation does not map the object or its sectional plane on itself.

BACKGROUND

A fan wheel is described in various versions in the publication JP 2001-263 294. In this case, the shroud or the baseplate or each of the two is to have a contour stepped obliquely in the circumferential direction. As a result of this step shape oblique in the direction of rotation, a tendency of the flow to break away is to be reduced and the noise and efficiency are thereby to be influenced positively. The result of the step shape is that each fan blade has different (axially measured) outlet widths on its suction side and on its delivery side, specifically, depending on the embodiment, the outlet width on the suction side may be smaller or greater than the outlet width on the delivery side.

EP 1 933 039 A1 describes a radial fan with ribs, clearances or indentations on the outside of the shroud. This configuration is to lead to a noise reduction as a result of a specific flow routing.

The further publication EP 1 032 766 B1 describes a fan wheel, in particular for a turbocharger. In this fan wheel, blades are formed by embossings on at least one of the two disks (baseplate and/or shroud). These embossings likewise give rise to a nonrotationally symmetrical geometry. However, this publication is not concerned with influencing the flow, but mainly contains manufacture-related and stability-promoting aspects.

Numerous further publications describe rotationally symmetrical fan wheels. Mention may be made here, merely by way of example, of the publications DE 29 40 773 A1, DE 199 18 085 A1, EP 1 574 716 B1 and DE 203 03 443 U1. Such fans with rotationally symmetrically designed baseplates and/or shrouds have, both in the direction of the axis of rotation and in the circumferential direction, in part, highly nonuniform velocity and pressure distributions, that is to say locally elevated velocity/pressure ranges. This may lead to flow breakaways and even backflows which, in turn, cause aerodynamic losses, losses of efficiency and also an increase in noise emission.

SUMMARY

The object on which the present invention is based is to provide a fan wheel of the type described in the introduction, by means of which, along with good mechanical stability, an improved influencing of the flow for optimization in terms of air performance, efficiency and noise behavior is achieved.

A first aspect of the invention is that the respectively nonrotationally symmetrical shroud or baseplate additionally has a continuous point-invariable profile on the respective outsides of the baseplate and/or shroud over the entire circumference (also over the regions of the blades), as seen in the axial or axially parallel direction. This means that, between two radial sections running through the axis, there is a critical angle $\alpha_G > 0°$, beyond which the result of a further approach of the two radial sections is that the dimensional deviations also decrease in the axial direction of the respective outsides of the baseplate and/or shroud. It is therefore a question of an invariable profile in the axial direction, a marked improvement thereby being achieved, as compared with the stepped profile, for example according to JP 2001-263 294 and also according to EP 1 933 039 A1.

In addition to, but, if appropriate, also alternatively to this first aspect of the invention, in a second aspect there may be provision whereby the respectively nonrotationally symmetrical shroud or baseplate is designed without a jump, over the fan blade, between two radial sections containing the axis of rotation and lying on both sides of each fan blade. This, too, is advantageous with a view to achieving the basic object.

In a further refinement of the invention, the deviation in geometry of two different sections, containing the axis of rotation, of the respectively nonrotationally symmetrical disk (shroud or baseplate) in the radial direction may be arbitrary (in contrast to the always point-invariable profile according to the invention in the axial direction). This means that selectively a point-invariable or else a jump-like profile is possible radially.

While the velocity and pressure distribution in the direction of the axis of rotation can be influenced by means of the geometric configuration of the fan blades and the configuration of the flow ducts, formed between the blades, through a known rotationally symmetrically designed baseplate and/or shroud, the nonuniformity in the circumferential direction remains as far as possible uninfluenced by this. In contrast to this, by means of the nonrotationally symmetrical configuration according to the invention, an advantageous influence can additionally be exerted in a directed manner upon the circumferentially occurring nonuniformity of the velocity and pressure distribution. This results, inter alia, in the following advantages:

- influencing of the outflow from the fan wheel such that an equalization of the flow, above all in the circumferential direction, and, as a result of this, a reduction in the maximum flow velocity occurring locally takes place, this having a positive effect on aerodynamic and acoustic properties of the fan wheel; in particular, an improvement in the efficiency and in noise emission is thereby achieved.
- Directed influencing of the flow in the fan wheel in order to reduce interactions with the blade duct boundary walls for noise reduction and for improving the air performance and the efficiency.

More degrees of freedom for influencing the flow (above all, in the circumferential direction) and flow routing; as a result, stabilization of the flow in the blade duct and therefore a reduction in the tendency of the flow to break away.

Improvement in mechanical stability; as a result, a saving of material also possible.

BRIEF DESCRIPTION OF THE DRAWINGS

The invention, then, will be explained in more detail by means of several exemplary embodiments illustrated in the drawing in which:

FIG. 1 shows a first embodiment of a fan wheel according to the invention, specifically, in FIG. 1*a*, a perspective view and, in FIG. 1*b*, an axial section in a diametral sectional plane, FIGS. 2 to 9 show in each case a further different version of the fan wheel, in each case a part figure a) illustrating a perspective view and a part figure b) illustrating a side view, and FIG. 10 shows a further perspective view of a fan wheel according to the invention, for example in a version as in FIG. 4*a*, in an enlarged scale for a further explanation of the invention.

DETAILED DESCRIPTION

In all the exemplary embodiments, a fan wheel 1 according to the invention, to be driven in rotation about an axis of rotation Z, consists of a shroud 2 with a preferably essentially centric inlet port 4 for the inflow of air, of a baseplate 6 lying opposite in the axial direction Z and a plurality of fan blades 8. These fan blades 8 are arranged between the baseplate 6 and the shroud 2 or are formed completely or in regions by a specific shaping of the baseplate 6 and/or of the shroud 2 (cf. FIG. 8), the disks 2, 6 then being connected directly to one another in these regions. The fan blades 8 are arranged in a specific circumferential distribution about the axis of rotation Z and the inlet port 4. Formed in the circumferential direction in each case between two adjacent fan blades 8 are blade ducts 10 which lead radially or diagonally outward from the region of the inlet port 4 and form blow-out ports on the outer region of the fan wheel 1.

In the fan wheel 1 according to the invention, it is first essential that the shroud disk 2 or the baseplate disk 6 or else each of the two disks 2, 6 has a nonrotationally symmetrical geometry.

In this respect, reference may be made at this juncture to FIG. 10 where, in addition, two radial planes E1 and E2, that is to say planes running in a manner corresponding to a radius r and intersecting in the axis of rotation Z, are depicted, said planes forming a specific differential angle $\alpha$. Nonrotational symmetry within the meaning of the present invention occurs when the cross-sectional areas of the respective disk 2 and/or 6, which lie in the planes E1 and E2, differ from one another in the case of different circumferential angles.

In this case, however, additionally, the profile of the respectively nonrotationally symmetrical disk 2 and/or 6 in the axial direction, on the respective outsides of the baseplate 6 and/or shroud 2, is point-invariable over the entire circumferential region (also over the blades), that is to say, with a decreasing differential angle $\alpha$, there is a critical angle $\alpha G>0°$, beyond which the result of a further approach of the two radial sections E1 and E2 (FIG. 10) is that the dimensional deviations in the axial direction Z of the respective outsides of baseplate 6 and/or shroud 2 also decrease. Alternatively or additionally to this, there is provision whereby two cross sections, which lie in two planes containing the axis of rotation Z and consequently intersecting in the axis of rotation Z, do not form any jump in the direction of rotation over the blade 8 on both sides of each fan blade 8.

In contrast to the point-invariable profile in the axial direction Z, according to the invention the deviation in the geometry of two different sections containing the axis of rotation Z may be arbitrary in the radial direction (radius r in FIG. 10). This means that both point-invariable and jump-like profiles are possible here.

The individual exemplary embodiments will be described briefly in more detail below.

In the version according to FIG. 1, the shroud 2 is equipped with a wheel inlet 12 in the region of the inlet port 4, the shroud 2 being designed in the region of this wheel inlet 12 to be nonrotationally symmetrical in the direction of the axis of rotation Z. In the example illustrated, the wheel inlet 12 extends, web-like, away from the shroud 2 axially and in the circumferential direction has a wavy contour with axial elevations and with depressions running between them. The fan wheel 1 is in this case designed as a radial fan.

The version according to FIG. 2, in addition, is also a radial fan, in this case only the shroud 2 being designed to be nonrotationally symmetrical in the direction of the axis of rotation Z. In this example, for this purpose, the shroud 2 is designed to be wavy in the circumferential direction, in each case a convexly outward-curving portion being formed between two fan blades 8. These portions merge invariably one into the other in the region of each fan blade 8.

FIG. 3 illustrates a version as a radial fan in which only the baseplate 6 is designed to be nonrotationally symmetrical in the axial direction Z. This may be, in concrete terms, a configuration identical to that provided in the case of the shroud 2 according to FIG. 2.

The version according to FIG. 4 combines virtually both versions according to FIGS. 2 and 3. This means that this radial fan is designed to be nonrotationally symmetrical both in the region of the shroud 2 and in the region of the baseplate 6.

FIG. 5 illustrates a version of the fan wheel 1 as a diagonal fan, the shroud 2 being designed to be nonrotationally symmetrical in the radial direction r, specifically, in this case, not invariably, but in a jump-like manner. This is achieved by means of a non-invariable profile of an outer circumferential edge 14 of the shroud 2, which profile, instead, jumps across corners in the radius.

FIG. 6 shows a version as a radial fan, the shroud 2 being designed to be nonrotationally symmetrical in the radial direction r, specifically to be point-invariable.

This means that the shroud 2 has an invariable circumferential profile here without corners or other jumps.

The same also applies correspondingly to the very similar version according to FIG. 7, in which, however, in each case a corner or a bend occurs at points P.

FIG. 8 shows a version as a radial fan, the two disks, both the shroud 2 and the baseplate 6, being designed to be nonrotationally symmetrical in the direction of the axis of rotation Z by means of a contour profile which is wave-like in the circumferential direction. In addition, there is provision, here, whereby the shroud 2 and the baseplate 6 are connected to one another directly in the outer circumferential region of the fan wheel 1 and thus together form at least one part region of the fan blades 8. For the sake of clarity, a part region of the shroud 2 is cut away in the region of one of the blade ducts 10 in the additional FIG. 8*c*. Basically, the fan blades 8 could be formed completely in that the correspondingly shaped baseplates and/or shrouds 6, 2 are connected to one another directly over the entire profile of the blades 8. In the version illustrated, however, the disks 2, 6 are connected to one another only in the outer circumferential region, conventional blade portions being formed as separate parts in the inner inflow region of the blade ducts 10.

In all the embodiments described hitherto, the nonrotationally symmetrical configuration gives rise to geometric structures which are designed to recur periodically in the circumferential direction. It likewise comes within the scope of the invention, however, to select the geometric structures so that they are irregular in form or arrangement.

In this respect, an exemplary embodiment is illustrated in FIG. 9. Here, once again, there is a radial fan with a nonrotationally symmetrical shroud 2. The latter has a radius r changing abruptly at a circumferential point 16, and the outer circumferential edge 14 of the shroud 2 runs beginning from the circumferential point 16 with a continuously changing radius over the circumference and ends again after 360° at the radius jump in the circumferential point 16. In this example, therefore, the circumferential edge 14 has a spiral-like profile.

Of course, other versions are also possible, which result in a circumferentially irregular geometry of shroud and/or baseplate 2, 6.

What applies to all the embodiments is that the fan blades 8 may have any desired profile. For example, they may be curved forwards or backwards with regard to the direction of rotation.

Moreover, any desired combinations of all the individual features described hitherto are possible.

It is understood that the examples and embodiments described herein are for illustrative purposes only and that various modifications or changes in light thereof will be suggested to persons skilled in the art and are to be included within the spirit and purview of this application and scope of the appended claims.

The invention claimed is:

1. A fan wheel in the form of a radial or diagonal fan, comprising a shroud with an inlet port, a baseplate, and a plurality of fan blades arranged so as to be distributed over the circumference of the inlet port and around an axis of rotation, at least one of the shroud and the baseplate having a nonrotationally symmetrical geometry, wherein the nonrotationally symmetrical geometry having a continuous point-invariable profile, as seen in the axial or axially parallel direction with respect to the axis of rotation, the shroud being nonrotationally symmetrical in the direction of the axis of rotation in the region of an axially projecting wheel inlet surrounding the inlet port.

2. The fan wheel according to claim 1, wherein the nonrotationally symmetrical geometry is lacks a jump over the fan blade, between two radial sections containing the axis of rotation and lying on both sides of each fan blade.

3. The fan wheel according to claim 1, wherein the nonrotationally symmetrical geometry has, as seen in the radial direction with respect to the axis of rotation, a continuous point-invariable profile or a noncontinous jump-like profile.

4. The fan wheel according to claim 1, wherein the nonrotationally symmetrical geometry is designed to recur periodically or to be irregular in the circumferential direction with regard to form and/or arrangement.

5. The fan wheel according to claim 1 wherein the wheel inlet has a wavy profile contour with alternating projections and depressions.

6. A fan wheel in the form of a radial or diagonal fan, comprising a shroud with an inlet port, a baseplate, and a plurality of fan blades arranged so as to be distributed over the circumference of the inlet port and around an axis of rotation, further comprising blade ducts formed between every two adjacent fan blades and axially limited by the shroud and by the baseplate, the blade ducts leading radially or diagonally outward from a region of the inlet port and form blow-out ports on an outer region of the fan wheel in the circumferential direction, wherein at least one of the shroud and the baseplate has a nonrotationally symmetrical geometry with a continuous point-invariable profile, as seen in the axial or axially parallel direction with respect to the axis of rotation, at least one of the baseplate and the shroud having a wavy contour in the circumferential direction and forming a convexly outward-curving portion between two adjacent fan blades.

7. The fan wheel according to claim 6, wherein each two adjustment ones of the convexly outwardly-curving portions merge invariably one into the other in the region of each of the fan blades.

8. The fan wheel according to claim 6, wherein the fan blades are curved forwards or backwards with regard to the direction of rotation.

9. The fan wheel according to claim 6, wherein the shroud is nonrotationally symmetrical in the direction of the axis of rotation.

10. The fan wheel according to claim 6, wherein the baseplate is nonrotationally symmetrical in the direction of the axis of rotational.

11. The fan wheel according to claim 6 wherein one of the shroud and the baseplate is nonrotationally symmetrical in the radial direction.

12. The fan wheel according to claim 6, characterized in that the fan blades are formed at least in regions by means of a direct connection between the correspondingly shaped shroud and baseplate.

13. The fan wheel according to claim 9 wherein the shroud has a wavy configuration in the circumferential direction.

14. The fan wheel according to claim 6 wherein the baseplate has a wavy configuration in the circumferential direction.

* * * * *